US005648010A

United States Patent [19]

Dewitt et al.

[11] Patent Number: 5,648,010

[45] Date of Patent: Jul. 15, 1997

[54] LUBRICANT FOR AIR ENTANGLEMENT REPLACEMENT

[75] Inventors: Charles Gregory Dewitt, Matthews; Issac Dale Fleming, Charlotte, both of N.C.

[73] Assignee: Henkel Corporation, Plymouth Meeting, Pa.

[21] Appl. No.: 491,831

[22] Filed: Jun. 19, 1995

[51] Int. Cl.[6] ..... D06M 13/144; D06M 13/184

[52] U.S. Cl. ..... 252/8.84; 252/8.81; 252/8.82

[58] Field of Search ..... 252/8.6, 8.8, 8.81, 252/8.84, 8.82

[56] References Cited

U.S. PATENT DOCUMENTS

| | | | |
|---|---|---|---|
| 3,997,450 | 12/1976 | Steinmiller | 252/8.7 |
| 4,072,617 | 2/1978 | Jahn | 252/8.6 |
| 4,725,371 | 2/1988 | Lees et al. | 252/8.9 |
| 5,153,046 | 10/1992 | Murphy | 252/8.6 |

FOREIGN PATENT DOCUMENTS

| | | | |
|---|---|---|---|
| 62-078265 | 4/1987 | Japan | 252/8.6 |

OTHER PUBLICATIONS

Chemical Abstract No. 107:178466, abstract of Japanese Patent Specification No. 62–125095 (Jun. 1987).

Chemical Abstract No. 118:82799, abstract of Japanese Patent Specification No. 4–194077 (Jul. 1992).

Chemical Abstract No. 122:190241, abstract of Japanese Patent Specification No. 6–34103 (Dec. 1994).

Chemical Abstract No. 124:10840, abstract of Japanese Patent Specification No. 7–216736 (Aug. 1995).

*Primary Examiner*—Anthony Green

*Attorney, Agent, or Firm*—Ernest G. Szoke; Wayne C. Jaeschke; Real J. Grandmaison

[57] ABSTRACT

A lubricant composition for textile fiber and yarn materials made of a blend of from about 10 to about 75 weight percent of a waxy fatty lubricant component and from about 90 to about 25 weight percent of a polyethylene glycol ester lubricant component having a molecular weight in the range of about 200 to 800, based on the weight of the composition.

9 Claims, No Drawings

LUBRICANT FOR AIR ENTANGLEMENT REPLACEMENT

FIELD OF THE INVENTION

The present invention is directed to a composition and process for lubricating synthetic filament fibers. More particularly, there is provided a lubricant which increases both bundle and fiber-to-fiber cohesion and integrity in synthetic yarns in the absence of an air entanglement step.

BACKGROUND OF THE INVENTION

Finishing compositions are generally applied to textile fibers to improve their subsequent handling and processing. Fiber finishes play an important role in assisting the fiber producer to manufacture the product, and enable the fiber producer's customers to carry out the required yarn and fabric manufacturing processes to obtain the finished textile product. The composition and amount of finish composition applied depend in large measure upon the nature, i.e., the chemical composition of the fiber, the particular stage in the processing of the fiber, and the end use under consideration.

For example, compositions referred to as "spin finishes" are usually applied to textile fibers after extrusion. These or other finishes which may be applied to yarn prior to hitting or winding, and to fiber tows prior to or at the time of crimping, drying, cutting, drawing, roving, and spinning, or to staple fibers prior to carding, i.e., web formation, and subsequent textile operations such as yarn manufacture or preparation of nonwoven webs are commonly called secondary or over-finishes. Such finishes provide lubrication, prevent static build-up, and afford a slight cohesion between adjacent fibers.

The application of such finishes is generally accomplished by contacting a fiber tow or yarn with a solution or an emulsion comprising at least one component having anti-static properties. In addition to a lubricant and anti-static agent, wetting agents, additives such as antioxidants, biocides, anti-corrosion agents, pH control agents, as well as emulsifiers are also commonly found in such finish mixtures. Finish compositions can also be applied to tow, yarn, or cut staple by spraying.

Acceptable finishes must fulfill a number of requirements in addition to providing desired lubricating and antistatic effects. For example, they should be easy to apply (and to remove if desired), they should have good thermal and chemical stability, they should not adversely affect the physical or chemical properties of the fibers to which they are applied and they should aid the subsequent processes to which the treated fibers are subjected, they should not leave residues on surfaces or cause toxic fumes or undesirable odors, they should provide for rapid wetting of fiber surfaces, they should be water-soluble or emulsifiable or solvent-soluble, they should have good storage stability, they should be compatible with sizes, nonwoven binders and other fiber treatments, they should not attract soil or cause color changes to the fibers, they should not interact with frictional elements used in texturizing and they should not be corrosive to machine parts.

Of the numerous compositions which have been proposed as fiber finishes, some of the more noteworthy may be found in the following prior art. For example, U.S. Pat. No. 4,072,617 discloses a finish for acrylic fiber consisting of an alkyl phenol ethoxylated with 40 to 200 moles of ethylene oxide, an amine salt of hydrogenated tallow alcohol phosphate, and a mixture of mineral oil, an ethoxylated aliphatic monohydric alcohol, and the amine-neutralized reaction product of an ethoxylated aliphatic monohydric alcohol phosphate. In addition, U.S. Pat. No. 3,997,450 relates to a finish composition for synthetic fibers such as polyamides and polyesters, consisting essentially of a lubricant selected from a mono- or diester of an aliphatic carboxylic acid with a monohydric aliphatic alcohol, or a refined mineral, animal or vegetable oil; an emulsifier containing up to 50 moles of alkylene oxide per mole of ester, alcohol, or amide wherein the reactive hydroxyl sites of the emulsifiers contain deactivating and cap groups; and an alkali salt of a dialkyl sulfosuccinic acid. Likewise, U.S. Pat. No. 4,725,371 is directed to a finish for the texturing of partially oriented polyester yarn wherein the composition has a pH of at least 10, and comprises an oil-in-water emulsion wherein the oil phase constitutes 2 to 25 weight percent of the emulsion. The oil phase comprises a lubricant selected from mineral oils, alkyl esters, glycerides, silicone oils, waxes, paraffins, naphthenic and polyolefinic lubricants, glycols, glycol esters, and alkoxylated glycol esters. The emulsifiers employed include soaps, glycerol fatty acid esters, sorbitan and polyoxyethylene sorbitan esters, polyglycerol esters, polyoxyethylene esters or ethers, polyoxyethylene polyol ether esters, polyoxyethylene amines and amides, partial polyol ester ethoxylates, sulfated vegetable oils, sulfonated hydrocarbons, and the like.

The purpose of a fiber finish is to provide fiber to metal lubrication and fiber to fiber cohesion, as well as eliminate static electricity. Although much of the basic work to elucidate the mechanisms of lubrication was done in the distant past, results of this work continue to be used to understand and apply results of frictional testing to current problems and the development of new finishes.

The contribution of frictional and antistatic properties can be observed throughout fiber manufacturing and processing. An example is the case of a low denier polypropylene staple fiber which is to be carded into a web and thermally bonded for some disposable nonwoven application. This requires a formulation which in conjunction with the fiber crimp, contributes a relatively high fiber to fiber friction which is important in insuring a carded web with good cohesion, uniformity, and integrity, and which compensates for the low stiffness of the fibers. Low fiber to metal friction is also a key factor in the processing of these staple fibers which have diameters on the order of only 15 to 20 micrometers.

Another example involves a slit film or ribbon type yarn intended for woven carpet backing for tufted carpets. During its manufacture, good wetting of the fiber surface by the finish and moderate frictional coefficients are required. For tufting, however, relatively low fiber to metal friction is a very important feature because of the action of tufting needles on the backing fabric.

Finally, low fiber to fiber friction is a highly desirable feature of continuous filament yarns used in cordage applications which involve twisting and plying to form compact structures which have a large amount of fiber to fiber contact. Low friction is desirable since it is generally associated with high flex resistance, high energy absorption and therefore, long life.

A different area of fiber-to-fiber friction is concerned with continuous filament yarns. This may be illustrated by some examples within the fiber manufacturing plant: package building in spinning and filament drawing or tow drawing are the major steps where the fiber-to-fiber friction is of critical importance. In yarn processing, yarn delivery in coning, stitch formation in knitting, filament damage in braiding, strength and elongation in cordage, slippage of weave in fabric, yarn-to-fabric friction in sewing, are some of the areas where yarn-to-yarn friction is important. Unfortunately, prior art finish compositions fail to provide adequate friction coefficients with respect to the bundle cohesion and scroop of synthetic fiber filaments. This lack of adequate bundle cohesion results in the following problems: migration of filaments from bundles in tri-color yarns resulting in color streaking; difficulty in handling yarns in a direct tuft carpet process in which yarns are not twisted prior to tufting resulting in stray filaments being snagged; the filament twisting process is hindered due to the filaments separating from the main body of the fiber bundle; during fiber manufacture multiple wraps of the multifilament bundles are taken on various rolls wherein the bundles have a tendency to wander resulting in individual filaments from one bundle becoming trapped in an adjacent bundle causing a breakdown in the process.

One commonly used method of increasing both bundle and fiber to fiber cohesion is referred to as air entanglement. This process involves passing air through the fibers so as to promote entanglement, thereby increasing density and cohesion. This process, however, requires the expenditure of capital for the purchase and maintenance of the equipment used for air entanglement, as well as the energy, whether it be gas or electric, required to operate such machinery. All of this added expense clearly is reflected in the production costs of synthetic filament yarns. Hence, it would be highly desirable to provide a composition which, when applied to filament fibers, would accomplish the objectives of enhancing bundle and fiber-to-fiber cohesion, thus eliminating the expense associated with the air entanglement process.

Accordingly, it is an object of this invention to overcome the aforementioned disadvantages of the prior art and provide the afore-noted desired advantages.

DESCRIPTION OF THE INVENTION

Other than in the operating examples, or where otherwise indicated, all numbers expressing quantities of ingredients or reaction conditions used herein are to be understood as modified in all instances by the term "about."

The foregoing and other related objects are achieved, and the disadvantages of the prior art are obviated, by the provision of a lubricant composition for textile fiber and yarn applications wherein the lubricant composition comprises a blend of (1) from about 10 to about 75 weight percent, preferably from about 25 to about 50 percent, of a waxy fatty lubricant component, and (2) from about 90 to about 25 weight percent, preferably from about 75 to about 50 percent, of a polyethylene glycol ("PEG") ester lubricant component having a molecular weight in the range of about 200 to about 800, all weights being based on the weight of the lubricant composition.

The lubricant composition of the present invention is a cohesive, non-aqueous, low viscosity, non-sticky composition. The lubricant composition is sufficiently hydrophilic so as to allow for the scouring and conductance of synthetic filament fibers on water jet looms, yet sufficiently hydrophobic to allow for lubricity of the filament fibers during the fiber weaving process. The lubricating wax component of the present invention imparts the hydrophobic properties to the lubricant composition and fiber filament bundle cohesion as well as enhancing high speed yarn delivery from a supply package. The PEG ester lubricant component imparts the hydrophilic properties and functions primarily as a lubricant and cohesive additive. When applied to yarn, particularly polyester yarn, the lubricant composition mimics air entanglement properties. It has been surprisingly found that a synergy exists between the PEG ester lubricant component and the waxy fatty lubricant component which, when combined, achieves the desired properties of bundle cohesion and integrity, filament to filament cohesion, fiber to metal lubricity, high speed package delivery of up to 2000 meters/min., non-tacky or sticky application effects, antistatic properties, low foaming, good package build and size and compatibility with conventional fiber application systems. The lubricant composition is particularly effective on textured polyester yarn scheduled for weaving and knitting applications.

The waxy fatty lubricant component is preferably selected from the group consisting of ethoxylated esters such as ethoxylated sorbitan monooleate, ethoxylated sorbitan monostearate, ethoxylated fatty acids such as ethoxylated oleic and stearic acids, and ethoxylated alcohols such as ethoxylated $C_{11}$–$C_{15}$ alcohol or combinations thereof. An alkali metal soap of a fatty acid such as potassium oleate may be included with an ethoxylate emulsifier, but it is not necessary. Preferred waxy fatty lubricant components include an ethoxylated sorbitan monooleate (POE(5)) such as commercially available from Henkel Corporation, Mauldin, S.C., under the trade name Emsorb 6901; POE (9) oleic acid under the trade name Emery 2646; POE (20) sorbitan monostearate commercially available under the trade name Ethsorbox S 20 from Ethox Co., Greenville, S.C.; and a polyethylene glycol ether of a secondary alcohol commercially available under the trade name Tergitol® 15-S-3 from Union Carbide Corporation, Danbury, Conn.

The PEG ester lubricant component of the lubricant composition is preferably selected from the group consisting of ethoxylated fatty acids such as the reaction product of ethylene oxide with pelargonic acid to form PEG 300 monoperlargonate, commercially available from Henkel Corp. under the trade name EMEREST® 2634, PEG 400 monopelargonate, commercially available from Henkel Corp. under the trade name EMEREST® 2654, the reaction product of ethylene oxide with coconut fatty acids to form PEG 400 monolaurate (cocoate), commercially available from Henkel Corp. under the trade name EMEREST 2650, and PEG 600 monolaurate (EMEREST 2661). Other suitable acids which may also be reacted with ethylene oxide include caprylic and capric acids, as well as mixtures of all of the above.

The lubricant composition of this invention is emulsifiable and capable of forming a stable emulsion with water. By the term "stable emulsion" it is meant that the emulsion is stable at the time of application of the lubricant composition to the yarn surface. This is meant to include oil-in-water finishes which may be mixed just prior to their application to the yarn surface and which may be stable only under conditions of mixing and application. Typically, however, the finish composition will be mixed well prior to yarn application and then applied via various applicators from a storage tank or the like and thus the emulsion must be stable for extended time periods.

The polyethylene glycol ester component has a molecular weight in the range of about 200 to 800, and preferably about 400. The viscosity of the polyethylene glycol ester is preferably in the range of about 20 to 80 centistokes, and most preferably about 45 centistokes, at a temperature of 100° F. The oxyethylene content of the polyethylene glycol ester component is from about 4 to about 20 moles, and preferably about 4 to 17 moles.

The lubricant composition of the present invention may be applied to virtually any polyester fiber material such as polyethylene terephthalate and polybutylene terephthalate or copolyesters thereof, SARAN, spandex and VINYON.

The present invention will be better understood from the examples which follow, all of which are intended to be illustrative only and not meant to unduly limit the scope of the invention. Unless otherwise indicated, percentages are on a weight-by-weight basis.

EXAMPLE I

A lubricant composition for fiber and textile applications was prepared having the following formulation.

| Component | %/wt. |
|---|---|
| (a) POE (20) (20 moles E.O.) | 50 |
| (b) EMEREST 2634 | 50 |
| | 100.0 |

(a) POE (20), available from Ethox Corporation, Greenville, S.C., is an ethoxylated sorbitan monostearate;

(b) EMEREST 2634, available from Henkel Corporation, Textiles Group, Mauldin South Carolina, is the reaction product of ethylene oxide and perlargonic acid having an average molecular weight of about 300 and is identified as PEG 300 monopelargonate.

The components listed above and in the following examples, were blended together at ambient temperature using agitation. In each case the resultant blend was a clear liquid. Aqueous emulsions were prepared by adding the neat lubricant composition to water at ambient temperature while agitating the water. The resultant preparation in each case was a fluid, translucent emulsion.

EXAMPLE II

A lubricant composition for fiber and textile applications was prepared as in Example I having the following formulation:

| Component | %/wt. |
|---|---|
| (a) POE (20) | 50 |
| (b) EMEREST 2654 | 50 |
| | 100.0 |

(b) EMEREST 2654, commercially available from Henkel Corporation, Textiles Group, Mauldin, S.C., is the reaction product of ethylene oxide and perlargonic acid having an average molecular weight of about 400 and is identified as PEG 400 monopelargonate.

EXAMPLE III

A lubricant composition for fiber and textile applications was prepared having the following formulation.

| Component | %/wt. |
|---|---|
| (a) POE (20) | 75 |
| (b) EMEREST 2654 | 25 |
| | 100.0 |

EXAMPLE IV

A lubricant composition for fiber and textile applications was prepared having the following formulation.

| Component | %/wt. |
|---|---|
| (a) POE (20) | 55 |
| (b) EMEREST 2654 | 45 |
| | 100.0 |

Table 1 summarizes the typical properties of the lubricant compositions shown in Examples I–IV.

| PROPERTIES | EX. I | EX. II | EX. III | EX. IV |
|---|---|---|---|---|
| Activity, % wt. | 91.5–92 | 94–95 | 92.5–95 | 99 |
| Appearance | Clear, colorless liquid | Clear, colorless liquid | Clear, liquid | Clear, colorless liquid |
| Ionic Character | nonionic | nonionic | nonionic | nonionic |
| Moisture, % | 8.0–8.5 | 5–6 | 5–7.5 | 1 |
| Sp. Gr., 25° C. | 1.05 | 1.04 | 1.07 | 1.06 |
| Density, lb/gal., 25° C. | 8.7 | 8.6 | 8.9 | 8.8 |
| pH, 5% distilled water | 5.5–6.5 | 5.5–6.5 | 45.–6.5 | 4.5–6.5 |
| Viscosity, 100° F., cs | 35–55 | 35–55 | 45–55 | 40–50 |
| Thermal Properties: Flash Pt, °F., (C.O.C.) | >200 | >200 | >200 | >200 |

The lubricant compositions disclosed in the foregoing examples are eminently suitable for textile fiber and yarn applications due to their overall properties. Thus, according to another aspect of the invention there is provided a process for mimicking air entanglement properties, thus enhancing the cohesion of multiple synthetic fibers comprising contacting the synthetic fibers with an effective amount of the above-described lubricant composition.

EXAMPLE V

The lubricant composition of Example II was applied to 70 denier unentangled polyester yarn at a concentration of about 2% by wt. based on the weight of the yarn. The yarn was tested using a Package Performer Analyzer (PPA). This instrument determines the maximum speed that yarn can be removed from a package. It was found that this yarn could be removed from the package at a speed of up to 2,000 meters per minute when applying the lubricant composition to the yarn. In general, too much yarn cohesion impedes its removal, and inadequate cohesion affects proper package build-up.

Thus, the lubricant composition of this invention provides many desirable advantages. That is, the lubricant enables bundle cohesion without requiring the use of air for entanglement providing substantial energy savings; it enables yarn delivery at a speed of at least 1500 meters/minute or greater; it is effective at low add-on levels of about 2% by weight of the yarn; it is size-compatible; it is scourable when desirable, e.g., prior to a dyeing step; it may be applied to yarn by a kiss roll; it is low-foaming; it provides low fiber to metal frictions; and is effective on water jet looms.

Synthetic fibers such as polyamide and polyester fiber (filament) will typically require from about 1.5 to about 4.0% by weight finish to be applied on the fiber.

The lubricant composition may be applied onto the filament according to a variety of known procedures. For example, in the melt spinning process used for polypropylene manufacture, the polymer is melted and extruded through spinnerette holes into filaments which are cooled and solidified in an air stream or water bath. Shortly after, they contact a lubricant composition applicator which can be in the form of a kiss roll rotating in a trough. The amount of lubricant composition applied to the filaments can be controlled by the concentration of finish composition in the solution or emulsion and the total wet pick-up. Alternatively, positive metering systems may be used which pump the lubricant composition to a ceramic slot which allows the lubricant composition to contact the moving filaments.

From this point, the yarn which now has a coating of lubricant thereon moves forward into any of several processes. The amount of lubricant composition to be applied onto a synthetic filament is also dependent on the end product of the filament yarn. If staple fiber is the desired product, the filament bundles are combined into large tows, oriented by stretching, crimped, and cut into short lengths for processing on textile equipment to ultimately make yarn or nonwoven webs. In this instance, it is the "scroop" of the fibers which is intended to be enhanced. In order to do so, it is preferred that the lubricant composition be added in the range of from about 0.1 to about 0.3% by weight, based on the weight of the staple fiber. If continuous filament yarn is the desired product, the filaments are also oriented but as discrete bundles containing a specific number of filaments and are wound as long continuous lengths. In this case, the "bundle cohesion" of the filaments are enhanced by applying the lubricant composition of the present invention in the range from about 0.4 to about 0.7% by weight, based on the weight of the filament yarn. There are several versions of this process.

In one version the unoriented or undrawn yarn is wound on a package, and drawn on a drawtwister. In another version called spin draw, the drawing operation is carried out in a continuous fashion on the same equipment without the step of winding the undrawn yarn.

Texturized yarns are also made as continuous filament yarns. Again, texturized yarns can be made by texturizing a fully oriented yarn or by simultaneously orienting and texturizing a partially oriented yarn.

In some of these processes the original spin finish composition application carries the fibers through the entire process. In others, supplementary or overfinishes are applied somewhere later in the process.

Lubricant Composition Evaluations

As earlier indicated herein, frictional, antistatic, thermal, and wetting properties of the lubricant composition are crucial with regard to fiber performance.

Frictional properties can be readily measured by applying known amounts of lubricant composition to yarns under controlled conditions in the laboratory. Recognizing that laboratory measurements at best only simulate actual use conditions, they have nevertheless been found to be a reasonably good predictor of behavior. One of the well-known instruments for performing frictional measurements is the Rothschild F Meter. In case of fiber to metal friction, the measurement is carried out by pulling a yarn around a circular metal pin under conditions of known pre-tension and angle of contact. The output tension is measured and the coefficient of friction determined from the capstan equation $$T_2/T_1=e^{\mu\Theta}$$

where $T_1$ and $T_2$ are the incoming and outgoing tensions respectively, $\Theta$ the angle of contact in radians, and $\mu$ the coefficient of friction. The Rothschild instrument calculates and plots the coefficient of friction automatically. Some prefer to use the value of $T_2-T_1$ as a measure of the frictional force since strictly speaking the capstan equation is not accurately obeyed by compressible materials such as fibers.

There are a number of variables, both mechanical and physical, in addition to the pretension and angle of contact, which can influence friction measurement results. Some of these are speed, surface roughness, surface temperature, ambient temperature and humidity, finish composition viscosity, uniformity of finish composition application, finish composition concentration on the fiber, and fiber size and shape. Thus, when performing laboratory frictional experiments to determine the performance of a finish composition, one should select a condition related to that which the yarn will be exposed, such as for example, frictional measurements against a heated surface.

The fiber to fiber friction measurement is carried out in a similar way except that the yarn is twisted around itself and the force determined to pull the yarn in contact with itself. Again, with a knowledge of the incoming tension, the angle of wrap, and the outgoing tension, the frictional coefficient can be determined. In the case of fiber to fiber friction, it is customary to distinguish between static and dynamic frictional coefficients. Static friction is determined at a low speed (on the order of 1 cm/min), and dynamic friction at a higher speed. When measuring low speed friction, a stick-slip phenomenon is sometimes observed. It is this measurement which is most closely related to the "scroop" observed with staple fibers, or the cohesion of staple fiber web as it emerges from a card, or the performance of a finish composition in yielding a yarn package which is stable and does not slough. The stick-slip phenomenon indicates that the static friction is higher than the dynamic friction and can be affected by the behavior of boundary lubricants.

The antistatic properties of the lubricant composition also need to be evaluated. A typical antistat employed in the industry functions by either reducing the charge generation or by increasing the rate of charge dissipation. Most antistats operate by increasing the rate of dissipation and rely on atmospheric moisture for their effectiveness. A hydrophobic fiber such as polypropylene depends on an antistat coating to impart high surface conductivity for charge dissipation. There are several ways to assess the antistatic activity of a lubricant composition. During the measurement of fiber to metal friction and the passage of yarn around the metal pin, static charges are generated. The Rothschild friction meter has an electrostatic voltmeter attachment which measures the charge generated by the moving yarn. At periodic intervals, the static is discharged and allowed to rebuild. Correlation of the charge developed in this measurement with actual performance observed under various manufacturing and use conditions is generally very good provided the relative humidity is reasonably close to the test condition.

Another method for assessing the antistatic activity of the lubricant composition is to measure the time for a charge to dissipate after the fiber has been charged. This is called the half-life measurement, but it is not conducted on a moving yarn. Still another technique is to measure the resistivity of a non-moving yarn using an ohm-meter capable of measuring high resistance. Theoretically, the higher the resistance, the lower the conductivity and the poorer the antistatic properties.

The effect of aging on the antistatic properties of the lubricant composition can also be determined by any of these methods.

The effect of frictional and static properties is generally obvious throughout fiber manufacture and processing. Fiber to fiber friction is important to the fiber producer in controlling formation and stability of filament yarn packages since sloughing can occur if it is too low. Also, if fiber to fiber friction is too low, there could be problems of poor web cohesion in carding of staple fibers. On the other hand, low fiber to fiber friction is very desirable for continuous filament yarns which are used in applications such as cordage which involves twisting and plying. Low friction is desirable since it is associated with high flex resistance and high energy absorption and therefore, long life. Fiber to metal friction is also very important in many of the fiber processes. Lower fiber to metal friction is generally preferred since there is less opportunity for damage to the fibers either by abrasion or heat generation as the yarn contacts metal surfaces.

What is claimed is:

1. A process of increasing the bundle and fiber-to-fiber cohesion of a polyester textile fiber or yarn material, comprising contacting said polyester textile fiber or yarn material with a lubricant composition consisting of a blend of from about 10 to about 75 weight percent of a waxy fatty lubricant component selected from the group consisting of an ethoxylated ester, ethoxylated fatty alcohol and mixtures thereof, and from about 90 to about 25 weight percent of a polyethylene glycol ester lubricant component having a molecular weight in the range of about 200 to 800 selected from the group consisting of the reaction product of ethylene oxide with an acid selected from pelargonic, caprylic, capric, coconut and mixtures thereof, all weights being based on the weight of said composition.

2. The process of claim 1 wherein said ethoxylated ester is selected from the group consisting of ethoxylated sorbitan monooleate, ethoxylated sorbitan monostearate and combinations thereof.

3. The process of claim 1 wherein said ethoxylated fatty alcohol is an ethoxylated $C_{11}$–$C_{15}$ alcohol.

4. The process of claim 1 wherein said polyethylene glycol ester lubricant component comprises the reaction product of ethylene oxide with pelargonic acid.

5. The process of claim 1 wherein said polyethylene glycol ester lubricant component has a molecular weight of about 400.

6. The process of claim 1 wherein said lubricant composition is applied to said polyester textile fiber or yarn material in an amount of from about 1.5 to about 4.0% by weight, based on the weight of said polyester textile fiber or yarn material.

7. The process of claim 1 wherein said lubricant composition is applied to said polyester textile fiber or yarn material in an amount of from about 0.1 to about 0.3% by weight, based on the weight of said polyester textile fiber or yarn material.

8. The process of claim 1 wherein said lubricant composition is applied to said polyester textile fiber or yarn material in an amount of from about 0.4 to about 0.7% by weight, based on the weight of said polyester textile fiber or yarn material.

9. The process of claim 1 wherein said polyester textile fiber or yarn material is selected from the group consisting of polyethylene terephthalate, polybutylene terephthalate and spandex.

* * * * *